US010128067B1

(12) United States Patent
Cleaveland et al.

(10) Patent No.: US 10,128,067 B1
(45) Date of Patent: Nov. 13, 2018

(54) THREE PHASE UNITIZED HIGH VOLTAGE SWITCH ASSEMBLY WITH A CANTILEVERED TELESCOPING BASE

(71) Applicant: CLEAVELAND/PRICE INC., Trafford, PA (US)

(72) Inventors: Charles M. Cleaveland, North Huntingdon, PA (US); James R. Shychuck, Greensburg, PA (US)

(73) Assignee: CLEAVELAND/PRICE INC., Trafford, PA (US)

( * ) Notice: Subject to any disclaimer, the term of this patent is extended or adjusted under 35 U.S.C. 154(b) by 21 days.

(21) Appl. No.: 15/632,317

(22) Filed: Jun. 24, 2017

Related U.S. Application Data

(60) Provisional application No. 62/447,644, filed on Jan. 18, 2017.

(51) Int. Cl.

| | |
|---|---|
| ***H01H 31/26*** | (2006.01) |
| ***H01H 31/28*** | (2006.01) |
| ***H01H 33/666*** | (2006.01) |
| *H01H 33/02* | (2006.01) |

(52) U.S. Cl.
CPC ..... *H01H 31/28* (2013.01); *H01H 33/6661* (2013.01); *H01H 33/022* (2013.01); *H01H 2223/052* (2013.01)

(58) Field of Classification Search
CPC ..... H01H 31/28; H01H 31/26; H01H 33/022; H01H 2223/052
See application file for complete search history.

(56) References Cited

U.S. PATENT DOCUMENTS

| | | | | |
|---|---|---|---|---|
| 5,014,863 | A * | 5/1991 | Vlaanderen | B66C 23/42 212/261 |
| 5,538,207 | A * | 7/1996 | O'Connell | H02G 1/04 182/2.11 |
| 5,821,486 | A * | 10/1998 | Paw | H01H 31/28 200/48 A |
| 8,226,069 | B2 * | 7/2012 | Devine | H02G 1/04 182/2.1 |
| 8,541,702 | B2 | 9/2013 | Blalock | |
| 9,355,797 | B1 * | 5/2016 | Cleaveland | H01H 31/28 |
| 2013/0026018 | A1 * | 1/2013 | Zhu | H01H 31/026 200/324 |

OTHER PUBLICATIONS

Cleaveland/Price Inc. Bulletin DB-104DHA09 (6 pages).
Cleaveland/Price Inc. Bulletin DB-128A02 (8 pages).
Cleaveland/Price Inc. Bulletin DB-600A12 (8 pages).

* cited by examiner

*Primary Examiner* — Felix O Figueroa
(74) *Attorney, Agent, or Firm* — Ronald S. Lombard

(57) ABSTRACT

Switch gear for interconnecting a plurality of power transmission lines including a number of high voltage switches arranged in three phase unitized relationship for routing power in one or multiple directions. The switches are pre-mounted on a beam to form a unitized assembly which is attached in the field to a vertical support structure or substation structure. The unitized assembly includes a telescoping base design that permits the width of the unitized assembly to be reduced so that the assembly can be transported by truck to the installation site and then the switch assembly may be extended to the final width for installation at the site. The telescopic base design is preferably cantilevered and includes free rolling capability for easily manually reducing or expanding the width of the unitized assembly when the beam is lying on a ground surface.

13 Claims, 5 Drawing Sheets

THREE PHASE UNITIZED HIGH VOLTAGE SWITCH ASSEMBLY WITH A CANTILEVERED TELESCOPING BASE

CROSS-REFERENCE TO RELATED APPLICATION

This is application claims the benefit of U.S. Provisional Application No. 62/447,644 filed Jan. 18, 2017, which is incorporated herein by reference in its entirety.

BACKGROUND OF THE INVENTION

The invention relates to a unitized high voltage switch assembly for electrical switchgear such as air break disconnect switches used in transmission and substation systems for the control and routing of power. And, in particular, to such a high voltage switch assembly having a plurality of high voltage disconnect switches mounted on a single member to form a three phase unitized assembly for quick installation with one or more switch blades per phase that rotate in the operative position to open and close the high voltage air break disconnect switches.

It is common in today's electrical utility industry for electric transmission and substation switches to be unitized, i.e., an electric transmission switch assembly can include a plurality of high voltage electric disconnect switches mounted in an arrangement attached to an elongated base member which is mounted vertically to a utility pole or to a substation structure. Such a unitized arrangement is disclosed as a phase over phase arrangement in U.S. Pat. No. 9,355,797 B1 issued to Charles M. Cleaveland, one the present inventors, and others, on May 31, 2016, and assigned to the present assignee, Cleaveland/Price Inc. of Trafford, Pa. The said U.S. Pat. No. 9,355,797 B1 is herein incorporated by reference as though fully set forth. Also, being currently marketed by Cleaveland/Price Inc. is a one-way unitized phase over phase arrangement that is also attached to an elongated base member which is mounted vertically to a utility pole. In this regard, reference is made to the present assignee Cleaveland/Price Inc.—Bulletin DB-600A12. Such a phase over phase unitized switch assembly when fully assembled is desirably shipped on a truck to its final location for installation on a utility pole in an electric utility system.

It has been found that such switch assemblies as disclosed in said U.S. Pat. No. 9,355,797 B1 and in said Cleaveland/Price Inc. Bulletin DB-600A12 which includes two-way and three-way switches, and the said one-way switch currently marketed by Cleaveland/Price Inc. are often too wide to ship legally on a truck on U.S. roads. Specifically, for example, a three-way 115 kV switch assembly is too wide to ship legally by truck on roads in the U.S. Higher voltage versions of this switch assembly and one-way untized switches are also too wide to ship legally by truck on roads in the U.S.

Reference is made to U.S. Pat. No. 8,541,702 B2 issued to Frank Clay Blalock, on Sep. 24, 2013, and assigned to Southern States, LLC of Hampton, Ga., which discloses a single phase non-unitized high voltage electric power switch that includes a platform with structural beams and struts that folds and unfolds for installation in the field.

It is therefore an object of the present invention to devise an improved and unique three phase high voltage switch assembly that permits shipping on trucks one-way, two-way or three-way switch assemblies that are attached to an elongated base member and that are specifically unitized and therefore very large and presently too wide to ship legally on a truck on roads in the U.S.

SUMMARY OF THE INVENTION

The prior art unitized two-way or three-way high voltage electric disconnect switch assembly disclosed in the previously mentioned U.S. Pat. No. 9,355,797 B1, is a unitized phase over phase two-way or three-way switch assembly that is fully factory adjusted before being shipped to the job site. This three phase unitized arrangement of high voltage disconnect switches is pre-mounted on a beam structure for installation on a utility pole in a phase over phase arrangement. This three phase unitized two-way or three-way switch assembly may include two side break high voltage disconnect switches for a two-way arrangement, and for a three-way arrangement, may also include a vertical break disconnect switch per phase. Also, as mentioned, such unitized switch assemblies may consist of a three phase one-way switch arrangement; which typically includes three center break high voltage disconnect switches mounted on a structure member for substation or transmission switch application. For these various unitized switch assembly arrangements, the three phase arrangement of switches is first pre-mounted via transverse switch support members on the beam structure at the factory and then after shipping is-installed in the field. The beam at the job site is attached to a utility pole such that the beam in the final installed position has a vertical orientation for a transmission application or a horizontal orientation when the beam is attached to the legs of a substation structure. The opening and closing of these switches requires for higher voltages increased width compared to lower voltages switch assemblies. For example, such prior art unitized switch assemblies including side break disconnect switches or center break disconnect switches of 115 kV or greater are too wide to legally ship by truck on U.S. public roads. The present invention is also applicable to high voltage double break electric disconnect switches which can also be mounted to a beam for a three phase unitized assembly which also can be too wide to ship on a truck. Examples of prior art unitized high voltage double break electric disconnect switches are shown in the Bulletin DB-104DHA09 entitled "Copper Double Break Switch" by the present assignee Cleaveland Price, Inc. and can be fitted with the disclosed invention (but not shown in the drawing figures).

The present invention eliminates the problem of such three phase unitized high voltage electric disconnect switches being too wide to be legally shipped by truck on U.S. public roads by providing such three phase high voltage untized one-way, two-way or three-way switch assemblies with a telescoping switch assembly base structure to permit the maximum width of the switch assembly base structure to be reduced to comply with the U.S., state and local government legal requirements concerning width of truck loads on public roads. The maximum width of such loads in the U.S. is dependent on individual state regulations and is often limited to 102 inches for shipping without special wide load permits. One aspect of the present invention is to use friction reducing components in combination with a new telescoping cantilever structure. The friction reducing components may be, for example, ball bearings to lower the force required to slide the heavy switch insulator structure which is supported on a cantilevered structure from a collapsed position for shipping by truck to a fully extended position to the point where the motion can be provided by just a manual push or pull of a person. The present invention eliminates the need for a crane or jacking device for folding or sliding the heavy unitized switch assembly into position. Also, the cantilevered collapsible base structure of the present invention provides linear guiding for the manual push and, after it is configured, for locking the base structure in the collapsed position for shipping, and, to thereafter lock the base structure in the fully extended final position after the switch assembly is removed from the truck for installation. The invention uses a telescoping cantilevered base structure for the three phase unitized switching assembly which provides an improved switch assembly over the single phase folding system of the foregoing mentioned Blalock patent which may require the use of crane assistance to rotate and unfold the heavy insulators clear of the ground. The present invention provides advantages over the prior art by providing an improved structure that offers little resistance to large cantilever loads from heavy insulators.

Such three phase unitized high voltage electric disconnect switches as stated are also used in substation installations, as well as transmission class installations, and this invention has broad application where the installation maybe horizontal upright and the switch assembly is unitized on a beam for quick install in a substation.

These and other aspects of the present invention will be further understood from the entirety of the description, drawings and claims.

DETAILED DESCRIPTION OF THE PARTICULAR EMBODIMENTS

Figure 1:
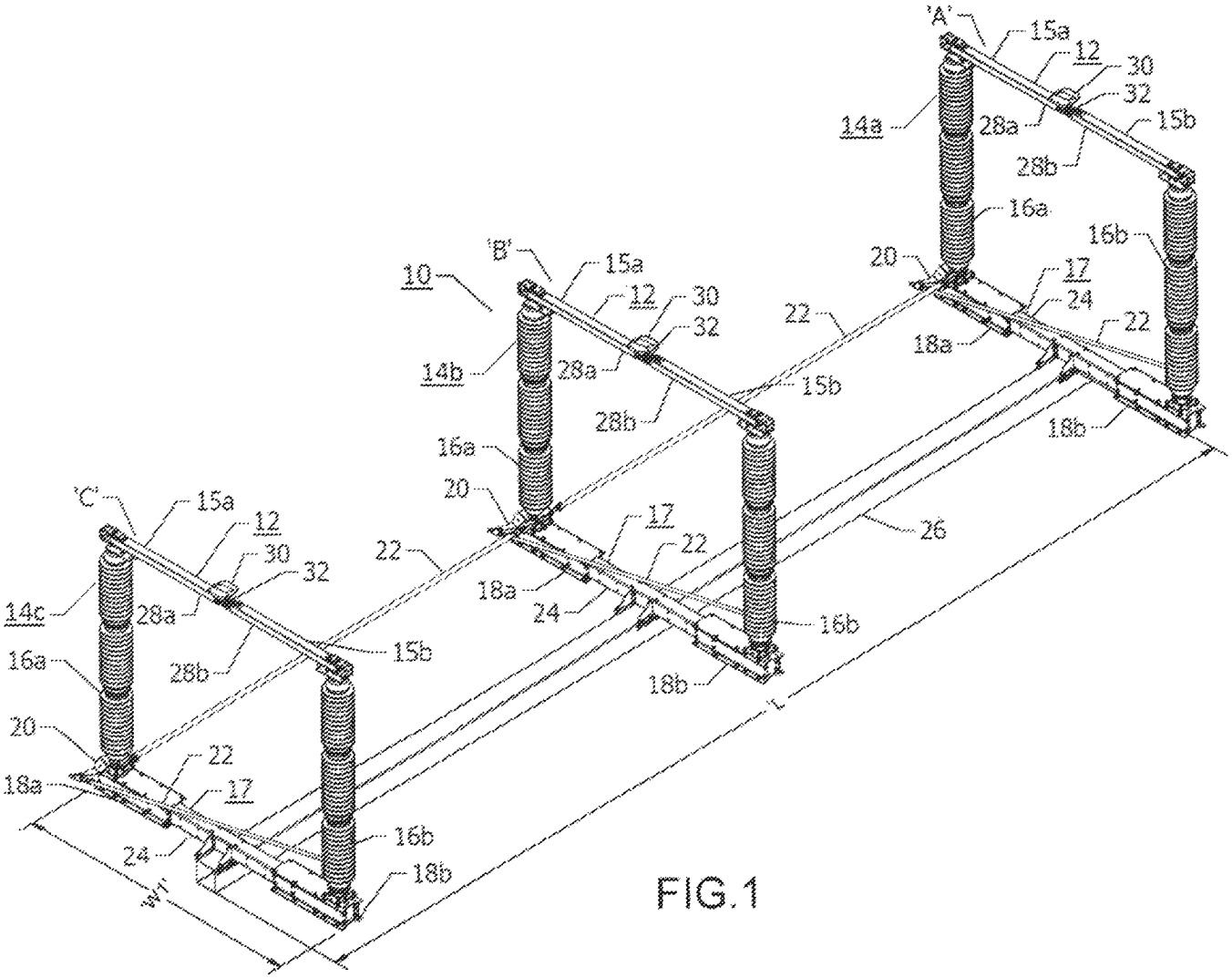
FIG. 1 is a perspective view of a three phase unitized high voltage switch assembly of the present invention in a one-way switch configuration for each phase with a center break high voltage disconnect switch in each phase with a cantilevered telescoping switch assembly base structure shown in the fully extended final installation position.
Figure 2:
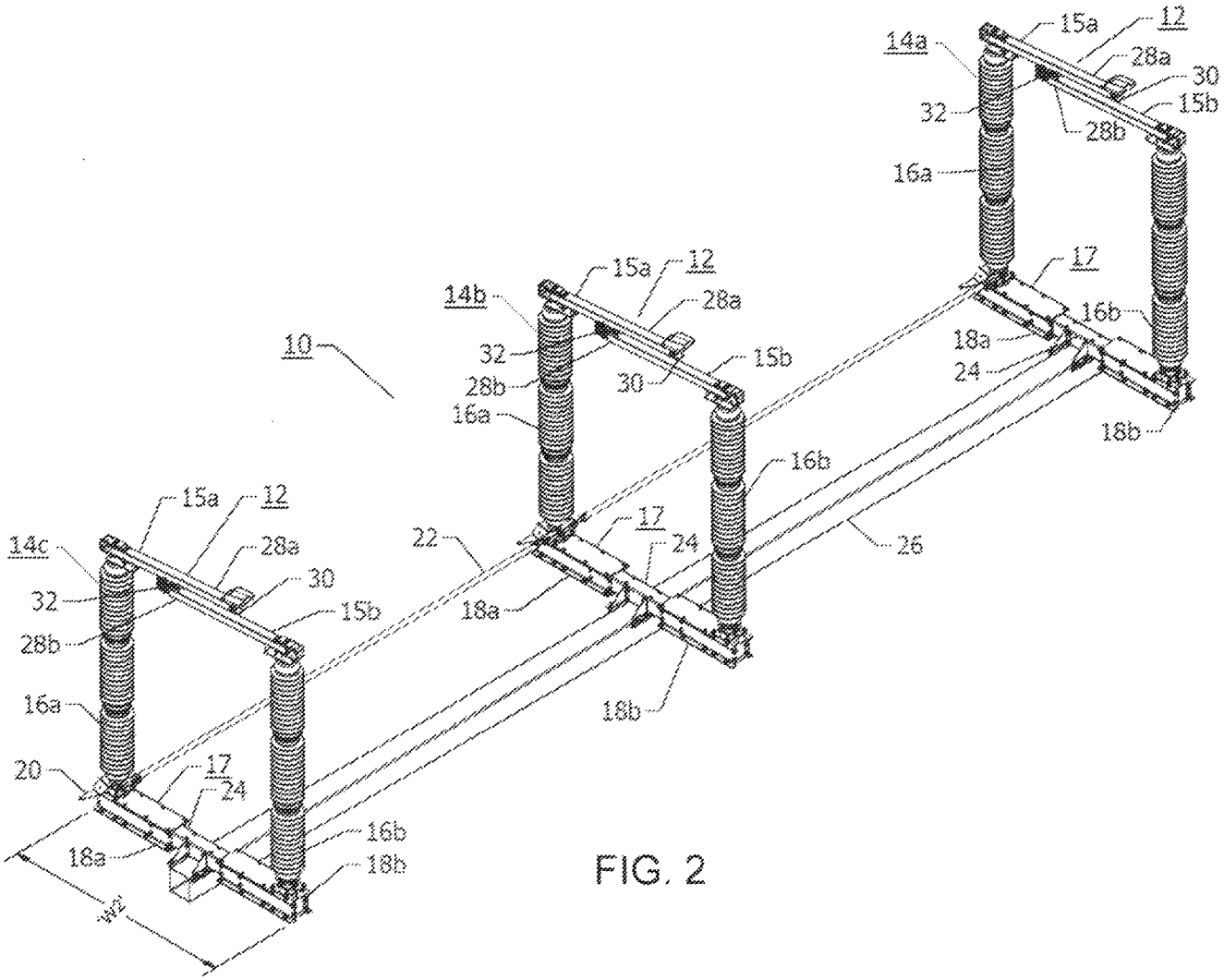
FIG. 2 is the same as FIG. 1 but the three phase unitized high voltage switch assembly is shown with the telescoping switch base structure in the fully retracted position for shipment by truck and the center break switches blades nested together partially open.

With reference to FIG. 1 there is shown a perspective view of a three phase unitized high voltage switch assembly 10 of the present invention in a one-way switch configuration with three switching units 14*a*, 14*b*, and 14*c* each arranged in one of the electrical phases 'A', 'B' and 'C'. Each switching unit 14*a*, 14*b*, and 14*c* is shown in FIG. 1 as comprising a single center break high voltage disconnect switch 12 with the switch assembly 10 in the fully extended position. The switch assembly 10 is adapted to be compatible with a three phase alternating current electrical power system which includes the phase 'A', an intermediate phase 'B' and phase 'C'. For further details of such center break switches from 69 kV to 230 kV, reference may be made to Bulletin DB-126A02, entitled "Aluminum Center Break Switch" by Cleaveland/Price Inc., the present assignee. The center break switch assembly 10 shown in FIG. 1 includes a plurality of rotating insulators 16*a*, 16*b* which are mounted on hollow elongated telescoping movable box structures 18*a*, 18*b* of transverse switch support member 17. The rotating insulators 16*a*, 16*b* upon rotation cause center break high voltage switches 12 to open. Each center break switch 12 includes two electrically conductive blades 15*a*, 15*b*. One of the blades 15*a* has at a distal end 28*a* a male contact 30 and the other blade 15*b* at a distal end 28*b* has a female contact 32. When the center break switches 12 are closed the male contact 30 engages the female contact 32 for current flow. The rotating insulators are rotated by imparting motion to drive levers 20 via lever arms 22, as is well known in the art, resulting in the synchronized operation of the three phases of switch assembly 10. The transverse switch support member 17 in addition to the telescoping movable box structure 18*a*, 18*b* includes a hollow elongated cross member 24. The telescoping movable box structure 18*a*, 18*b* of the present invention is configured to ride on, for example, the hollow elongated cross member 24 to provide the telescoping capability of the present invention. The hollow elongated cross member 24 of each phase 'A', 'B', and 'C' is immovably attached in predetermined position to an elongated longitudinal base member or beam 26. The cross members 24 are attached in spaced arrangement as shown in FIG. 1 to provide sufficient electrical separation between phases and thereby create a unitized assembly of all 3 phases with operating linkages 22 installed and factory adjusted for quick installation on a pole or substation structure. The longitudinal beam 26 when lying on a flat ground surface, or similar surface, elevates the telescoping movable box structures 18*a*, 18*b* so they do not touch the ground and are cantilevered with respect to cross member 24. The movable box structures 18*a*, 18*b* are able to telescope freely with respect to the cross member 24 by being manually pushed in towards the longitudinal beam 26 for shipping when the beam 26 is lying on a flat ground surface because the movable box structures 18*a*, 18*b* are clear of the ground. Manually moving the box structure with lower force is important for quick installation. Further details of the moveable box structures 18*a*, 18*b* and arrangement for telescoping with respect to the hollow elongated cross member 24 is subsequently described. FIG. 1, as stated, shows the switch assembly 10 in a fully extended position with 230 kV center break switches 12. This results in a maximum width 'W1' of the three phase unitized switch assembly of 127.25 inches, for example. The length of the unitized switch assembly is denoted by 'L' in FIG. 1 and may be 450.00 inches, for example, which fits on a truck without collapsing. FIG. 2 is the same as FIG. 1, but the center break switches 12 have been partially opened and the movable box structures 18*a*, 18*b* have been telescoped inwardly towards the beam 26 to obtain the minimum designed width 'W2' for this capacity center break switch 12 which in this case is 97.25 inches, for example. This is a legally permissible width for the switch assembly as a load carried on a truck on many roads in the U.S. without load permits. As mentioned the beam 26 elevates the movable box structures 18*a*, 18*b* above the ground so that the box structures can move without dragging on the ground during installation in the field unlike the prior art using a folding system.

Figure 3:
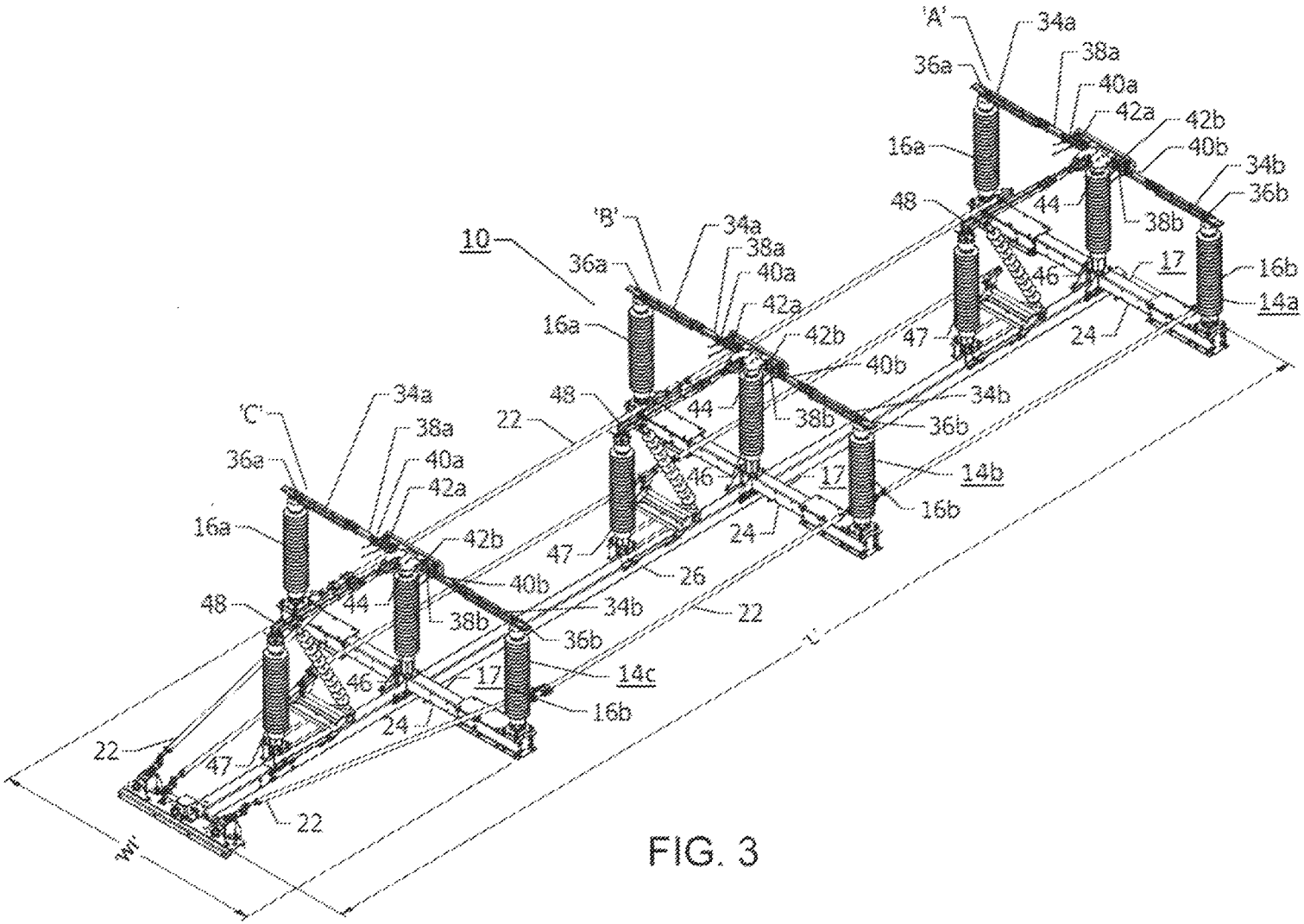
FIG. 3 is a perspective view of a three phase unitized high voltage switch assembly of the present invention in a three-way switch assembly for each phase including two side break high voltage disconnect switches and one vertical break switch with a cantilevered telescoping switch assembly base structure shown in the fully extended final installation position.
Figure 4:
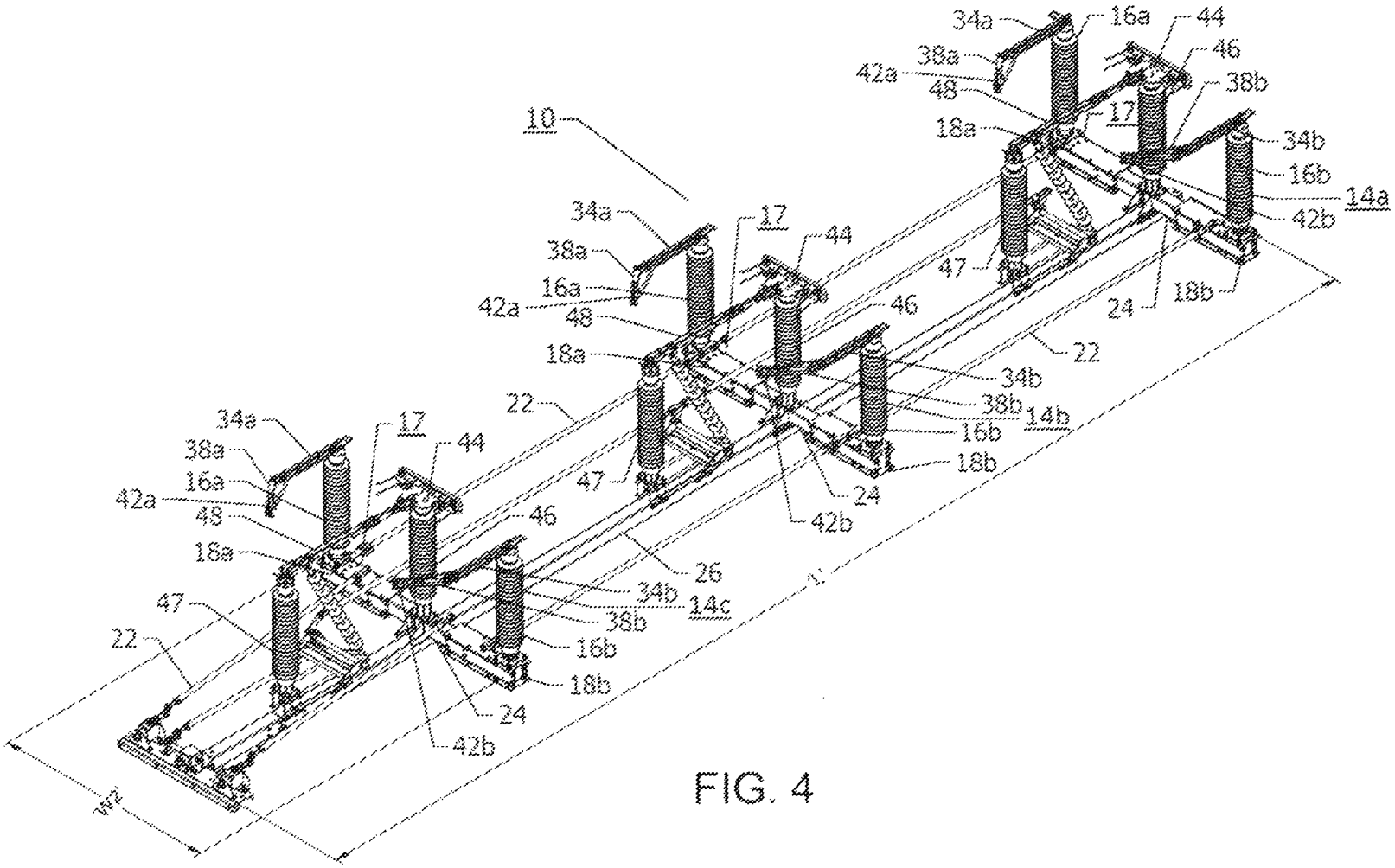
FIG. 4 is the same as FIG. 3, but the three phase unitized high voltage switch assembly is shown with the telescoping switch base structure in the fully retracted position for shipment by truck and the side break switches open.

With reference to FIG. 3, please note like reference numerals described for FIGS. 1 and 2 are also used with regard to FIG. 3 to describe similar components of FIG. 3. FIG. 3 depicts a three phase unitized high voltage switch assembly 10 with a three-way switch configuration for each phase instead of the previously described center break switch arrangement, i.e., the one-way switch arrangement shown in FIGS. 1 and 2. The unitized three-way switch configuration shown in FIGS. 3 and 4 includes, for each switching unit 14*a*, 14*b*, 14*c*, two side break high voltage disconnect switches 34*a*, 34*b* and a vertical break switch 48 as further described in the previously mentioned U.S. Pat. No. 9,355,797 B1 issued to the present assignee. The side break disconnect switch 34*a* is rotatably attached at a proximal end 36*a* to the rotating insulator 16*a* and the side break disconnect switch 34*b* is rotatably attached at a proximal end 36*b* to the rotating insulator 16*b*. The side break switch 34*a* includes a disconnect blade 38*a* and the side break switch 34*b* includes a disconnect blade 38*b* as shown in the closed position in FIG. 3 and in the open position in FIG. 4. The rotating insulators 16*a*, 16*b* shown in FIGS. 3 and 4 are attached to the movable box structures 18*a*, 18*b*. The rotatable insulators 16*a*, 16*b* upon rotation causes the side break disconnect switch blades 38*a*, 38*b* to open, which are articulated as shown in FIG. 4. As shown in FIG. 3, the distal ends 40*a*, 40*b* of each switch blade 38*a*, 38*b* have female contacts 42*a*, 42*b* which engage male contacts 44 which are mounted on stationary insulator 46. Also, the vertical break switch 48 is arranged as shown in FIG. 3 and is carried between the stationary insulator 46 and a second stationary insulator 47. The vertical break switch 48 can remain closed during transporting of the switch blade assembly and is not affected by the telescoping feature of the invention.

The movable box structures 18*a*, 18*b* shown in FIGS. 3 and 4 telescope with reference to the hollow elongated cross member 24 as described for the previous embodiment. The cross member 24 of each phase 'A', 'B', and 'C' is immovably attached by welding or bolting to the elongated longitudinal base member or beam 26. The cross members 24 are attached in spaced arrangement as shown in FIGS. 3 and 4 to provide the sufficient separation between phases. The movable box structures 18*a*, 18*b* are cantilevered and telescope collinearly with respect to the cross member 24 and may with little effort be manually pushed in towards the base member 26 for shipping when lying on a flat ground surface. A three way 115 kV switch assembly is shown in FIGS. 3 and 4 with a telescoping base. In the collapsed position as shown in FIG. 4, i.e. the moving portion, i.e., the telescoping movable box structures 18*a*, 18*b* are bolted to the cross member 24 for shipment as described subsequently. The moveable box structures 18*a*, 18*b* are also bolted to the cross member 24 after they have been manually extended to their final extended, i.e., widest position.

Figure 5B:
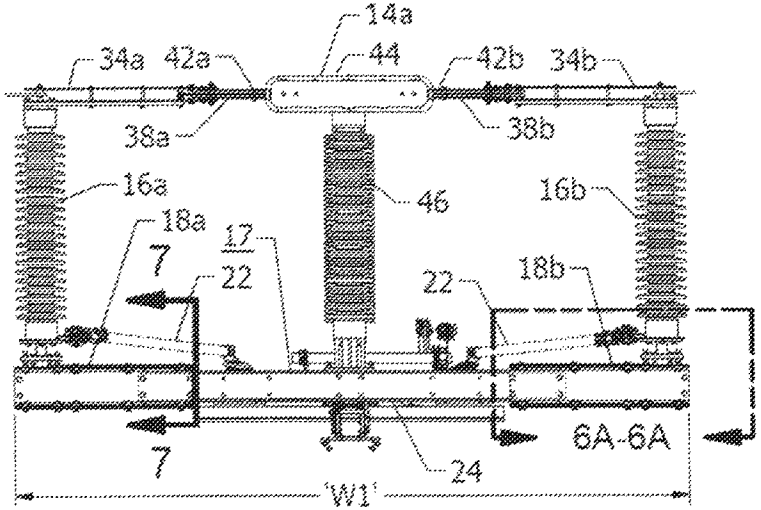
FIG. 5B is an end view of the switch assembly shown in FIG. 3 in the fully extended position.
Figure 5A:
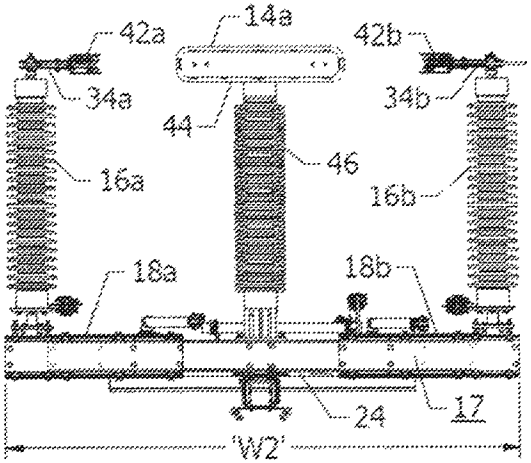
FIG. 5A is an end view of the switch assembly shown in FIG. 4 in the fully retracted or collapsed position.

Referring to FIG. 5A an end view of the switch assembly 10 shown in FIG. 4 is shown. FIG. 5A shows the switch assembly 10 for a 115 kV three phase transmission switch in a collapsed condition with a minimum width 'W2' of 101.00 inches for legal shipment on trucks in the U.S. FIG. 5B shows an end view of the switch assembly 10 shown in FIG. 3 in the fully extended, i.e., widest position with a maximum width 'W1' of 132.50 inches.

Figure 6B:
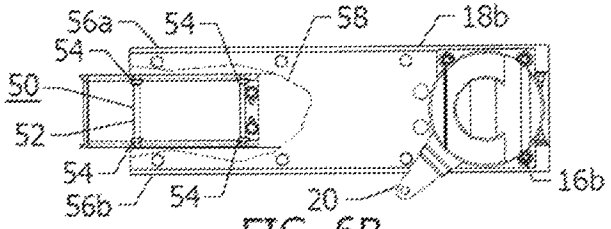
FIG. 6B is an enlarged top view partially cut away of the structure shown in FIG. 6A; and, FIG. 7 is an enlarged end view of Section 7-7 of FIG. 5B.
Figure 6A:
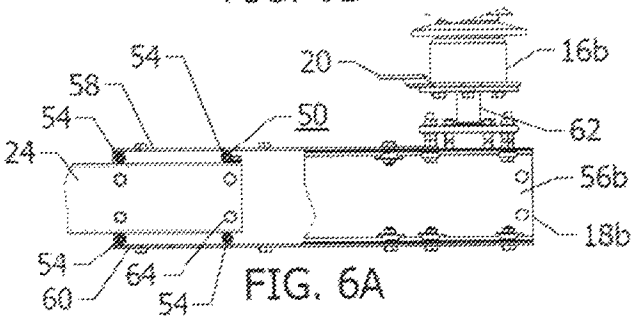
FIG. 6A is an enlarged side view partially cut away of section 6A-6A in FIG. 5B.

FIG. 6A is an enlarged side view partially cut away of the section denoted as '6A-6A' in FIG. 5B. As can now be seen in this enlarged view, the hollow elongated moveable box structure 18*b* is collinear with hollow elongated cross member 24. The movable box structure 18*b* has, for example, mounted within it four ball bearing or roller wheel and shaft assemblies 50 in predetermined position which permit reduced friction slidable telescoping movement of the movable box structure 18*b* over cross member 24. The predetermined distance between the ball bearing or roller wheel and shaft assemblies 50 such as nine inches, for example, gives the telescoping box structure 18*b* the ability to handle heavy insulator cantilever loads. As can be seen in FIG. 6B each ball bearing or roller wheel and shaft assembly 50 desirably includes a shaft 52 having ball bearings 54 mounted proximate opposite ends thereof. The shaft 52 is engaged into and between opposite channels 56*a*, 56*b* which forms opposite sides of the movable box structure 18*b* (not shown in the drawings). The movable box structure 18*b* also includes, as shown in FIG. 6B, a top plate 58 attached to the opposite channels 56*a*, 56*b* and also includes, as shown in FIG. 6A, a bottom plate 60 attached to the opposite channels 56*a*. 56*b*. The structure for movable box structure 18*a* is basically the same as for movable box structure 18*b* and therefore is not shown in the drawings. The ball bearing or roller wheels and shaft assemblies 50, in operation of the telescoping base of the present invention, roll on the cross member 24 via the ball bearings or roller wheels 54 when the switch is being telescoped, on a flat ground surface, as can be seen in FIGS. 5A and 5B. The ball bearings or roller wheels 54 permit the movable box structures 18*a*, 18*b* to roll easily with the weight of the heavy insulator. The eight ball bearings or roller wheels 54, four above and four below cross member 24, in each movable box structure 18*a*, 18*b* roll on the cross member 24 and top plate 58 and bottom plate 60 to handle the cantilever load of the heavy insulator. The two channels 56*a*, 56*b*, each support a rotatable switch insulator 16*a* and 16*b* and insulator bearing 62 as shown, for example, in FIG. 6A.

Figure 7:
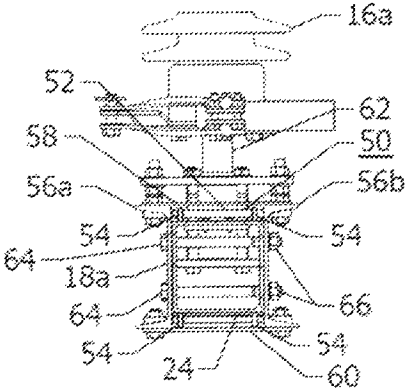

With reference to FIG. 7 which is an enlarged end view of section '7-7' of FIG. 5B further details of movable box structure 18*a* are shown. In order to lock the movable box structure 18*a* in both the shipping position for minimum width and for the assembly and final position for maximum width the channels 56*a*, 56*b* are provided with, for example, appropriately placed apertures, not shown in the drawings, to engage, for example, four bolts 64. The bolts 64 in the shipping position align with apertures in the movable box structure 18*a* and apertures in the central square tube member 24. The bolts 64 engage nuts 66 for locking the movable structure 18*a* with the cross member 24 in the shipping position. Once the switch assembly 10 reaches its final destination, the beam 26 is placed on a flat ground surface and the bolts 64 are removed and the movable box structure 18*a* being elevated off the ground is manually with little effort extended outwardly to the maximum width for final installation. The channels 56*a*, 56*b* and the movable box structure 18*a* are also provided with appropriately placed apertures not shown in the drawings for receiving bolts 64 which engage nuts 66 for locking the movable structure 18*a* with the cross member 24 in the final extended position for installation on a utility pole in the electric utility system. This locking scheme of the present invention applies equally to the other movable box structure 18*b*.

A two-way switch assembly, not shown in the drawings, is the same as in FIG. 3 which has the same principal components as described for the three-way switch assembly of FIG. 3, but only includes two side break switches 34*a*, 34*b* and no vertical break switch.

The three phase unitized switch assembly 10 of the present invention with the-same box structure 18*a* or 18*b* can be applied to a double break switch, not shown in the drawings, mounted to a beam for a unitized assembly with the collapsible invention. As previously mentioned, an example of prior art high voltage double break electric disconnect switches are shown and described in the Bulletin DB-104DHA09 entitled "Copper Double Break Switch" by the present assignee Cleaveland Price, Inc.

Another arrangement of the invention, not shown in the drawings, is a configuration where the collapsed dimension is achieved by only one movable box structure instead of two movable box structures. Also, this invention applies equally to one or more of the movable box structures supporting a stationary insulator instead of a rotating insulator.

What is claimed is:

1. A three phase unitized high voltage electric disconnect switch assembly including a switching unit per each electrical phase, each of the switching units including at least one high voltage electric disconnect switch, a longitudinal beam having attached thereto in predetermined spaced arrangement a plurality of transverse switch support members with one transverse switch support member per phase, each of said transverse switch support members having attached thereto two or more high voltage electrical insulators, at least one of said high voltage electrical insulators of each of said transverse switch support members adapted to be rotatable, each of said rotatable high voltage insulators of each phase in operative rotational arrangement for three phase operation, each of said at least one rotatable high voltage electrical insulators having a rotatable member of one of the high voltage electrical disconnect switches operatively attached thereto proximate a top end of the insulator, an improvement which comprises:

each of said transverse switch support members including at least one telescoping movable insulator support structure having one of said high voltage electrical insulators mounted thereto, each of said transverse switch support members further comprising a hollow elongated cross member in operative attachment to the longitudinal beam in predetermined position, said at least one telescoping movable insulator support structure in operative telescoping movable arrangement with the hollow elongated cross member, said switch assembly configured for a collapsed position for shipment and for an extended position for final electrical installation.

2. The three phase unitized high voltage electric disconnect switch assembly of claim 1, further comprising a friction reducing means for permitting ease in movement of the at least one telescoping movable insulator support structure on its respective hollow elongated cross member.

3. The three phase unitized high voltage electric disconnect switch assembly of claim 2, wherein said friction reducing means comprises a plurality of ball bearing or roller wheels and shaft assemblies.

4. The three phase unitized high voltage electric disconnect switch assembly of claim 1, further comprising locking means for locking said at least one telescoping movable insulator support structure in predetermined position on its respective hollow elongated cross member.

5. The three phase unitized high voltage electric disconnect switch assembly of claim 4, wherein said locking means is adapted to lock in a first position said at least one telescoping movable insulator support structure to its respective hollow elongated cross member for shipping and said locking means is adapted to lock in a second position said at least one telescoping movable insulator support structure to its respective hollow elongated cross member when the switch assembly is installed in final operative position.

6. The three phase unitized high voltage electric disconnect switch assembly of claim 4, wherein said locking means comprises bolt members passing through the at least one telescoping movable insulator support structure and its respective hollow elongated cross member.

7. The three phase unitized high voltage electric disconnect switch assembly of claim 1, wherein said plurality of high voltage electric disconnect switches comprises side break type switches or center break type switches or double break type switches.

8. The three phase unitized high voltage electric disconnect switch assembly of claim 1, wherein said switch assembly comprises a 2-way or 3-way switch configuration.

9. The three phase unitized high voltage electric disconnect switch assembly of claim 1, wherein each of said transverse switch support members includes two oppositely disposed telescoping movable insulator support structures, each in slidable telescoping arrangement with the respective hollow elongated cross member.

10. The three phase unitized high voltage electric disconnect switch assembly of claim 3, wherein the ball bearing or roller wheel and shaft assemblies are in predetermined spaced arrangement configured to provide cantilever load reactions to support the weight of one of the high voltage electrical insulators.

11. The three phase unitized high voltage electric disconnect switch assembly of claim 1, wherein each of the telescoping movable insulator support structures are elevated with respect to the longitudinal beam such that the hollow elongated telescoping movable insulator support structures do not touch the ground when the beam is lying on a ground surface.

12. The three phase unitized high voltage electric disconnect switch assembly of claim 10, wherein a first of said ball bearing or roller wheel and shaft assemblies is positioned below said respective cross member in operative contact therewith, when the longitudinal beam is lying on the ground, and a second of said ball bearing or roller wheel and shaft assemblies positioned above said respective hollow elongated cross member in operative contact therewith, and said upper second ball bearing or roller wheel and shaft assembly displaced a predetermined distance longitudinally inwardly towards the longitudinal beam from said lower first ball bearing or roller wheel and shaft assembly, whereby said telescoping movable insulator support structure is supported by said lower first ball bearing or roller wheel and shaft assembly and said upper second ball bearing or roller wheel and shaft assembly in cantilevered free rolling relationship.

13. The three phase unitized high voltage electric disconnect switch assembly of claim 1, wherein each of said at least one telescoping movable insulator support structure is a box structure.

* * * * *